US005484261A

United States Patent [19]

Biscay et al.

[11] Patent Number: 5,484,261

[45] Date of Patent: Jan. 16, 1996

[54] SYSTEM FOR REGULATING AIR SUPPLY CONDITIONS OF A TURBO SHAFT MACHINE

[75] Inventors: Pierre Biscay, Lons; Alain J. Farrando, Pau; Philippe D. Joubert, Angais; Jean-Bernard Martin, Ondres; Hubert H. Vignau, Navailles-Angos, all of France

[73] Assignee: Turbomeca, Bordes, France

[21] Appl. No.: 380,448

[22] Filed: Jan. 30, 1995

Related U.S. Application Data

[63] Continuation of Ser. No. 113,836, Aug. 30, 1993, abandoned.

[30] Foreign Application Priority Data

Sep. 25, 1992 [FR] France ..... 92 11457

[51] Int. Cl.[6] ..... F01D 17/12

[52] U.S. Cl. ..... 415/151; 415/160; 415/163; 415/914; 415/208.1

[58] Field of Search ..... 415/148, 150, 415/151, 160, 161, 162, 163, 914, 208.1

[56] References Cited

U.S. PATENT DOCUMENTS

| | | | |
|---|---|---|---|
| 2,962,258 | 11/1960 | Wagner | 415/148 |
| 4,167,368 | 9/1979 | Brobeck | 415/163 |
| 4,389,158 | 6/1983 | Nakanishi | 415/163 |
| 4,436,481 | 3/1984 | Linder | 415/163 |
| 4,531,356 | 6/1985 | Linder | 415/163 |
| 4,643,639 | 2/1987 | Caine | 415/148 |
| 4,729,715 | 3/1988 | Wilde | 415/150 |
| 4,867,637 | 9/1989 | Hayama | 415/151 |
| 4,927,325 | 5/1990 | Yano | 415/163 |

FOREIGN PATENT DOCUMENTS

| | | |
|---|---|---|
| 672432 | 3/1966 | France . |
| 2139741 | 12/1973 | France . |
| 2294345 | 7/1976 | France . |
| 2438156 | 4/1980 | France . |
| 3717590 | 3/1987 | Germany . |

*Primary Examiner*—John T. Kwon
*Attorney, Agent, or Firm*—Martin Smolowitz

[57] ABSTRACT

The invention provides a regulating system (23) for controlling the heating of the gases on the downstream side of the regulating system, attenuating the aerodynamic noise produced by the gyratory flow on the downstream side of the directing vanes (24) of the regulating system and facilitating the endoscopic inspection of the blades and vanes of a compressor (3) owing to the provision of a throughway passage (27) in the regulating system (23), and in particular a throughway opening in at least one directing vane (24).

11 Claims, 5 Drawing Sheets

FIG.5
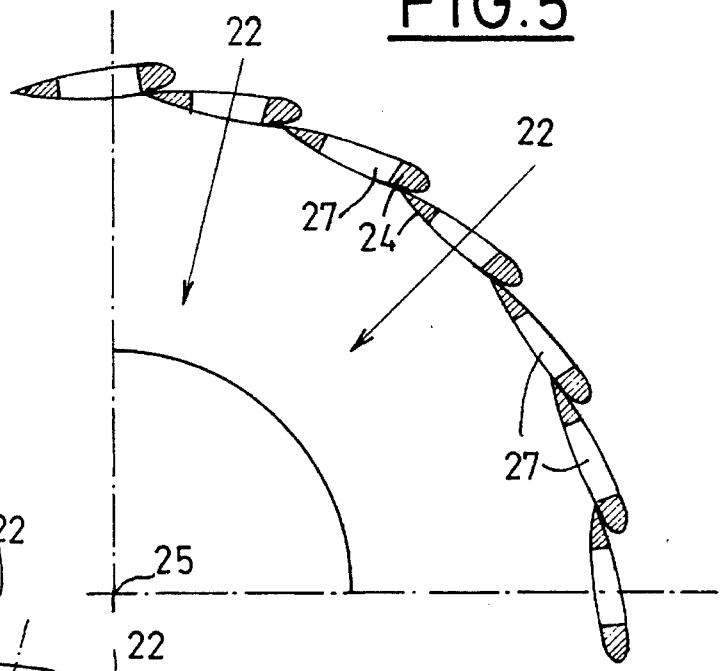
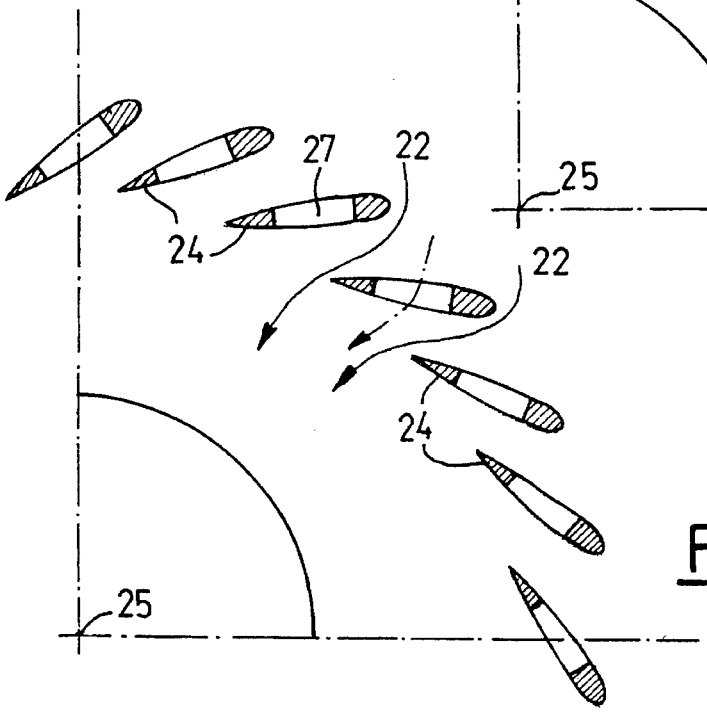
FIG.6
FIG.7
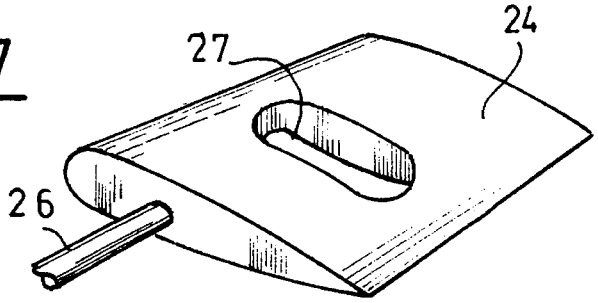

SYSTEM FOR REGULATING AIR SUPPLY CONDITIONS OF A TURBO SHAFT MACHINE

This application is a continuation, of application Ser. No. 08/113,836, filed Aug. 30, 1993, now abandoned.

BACKGROUND OF THE INVENTION

The present invention relates to a system for regulating the air supply conditions of a turboshaft machine.

The invention concerns in particular a regulation system for an air intake conduit system of a centrifugal compressor, and more particularly relates to an external centrifugal compressor of an auxiliary power unit employing a gas turbine drive.

The invention is more particularly applicable in the case of an annular conduit which is generally employed in turboshaft machines, and in particular in the intake part of the compressors, and which permits these machines to take in directly, or through a plenum, the surrounding air for suitably supplying air to their axial input part.

In the radial part of the gas intake conduit, means for regulating the air supply conditions of the turboshaft machine, such as directing vanes, are disposed around the axis of the machine and at even intervals on a given diameter. These vanes, arranged in the form of a ring, are generally of the design having a variable angular setting and they are simultaneously orientable between two extreme positions.

In one of these extreme setting positions, termed the completely open position, all the vanes are oriented substantially radially. In the other extreme setting position, termed the completely closed position, all the vanes are oriented tangentially relative to the annular gas inlet.

By modifying as required the angular setting of the vanes, it is possible to regulate with precision the air supply conditions of the compressor, and therefore to adapt the air flow and the pressure level delivered to the different circuits fed by this compressor.

In particular, and in the case of the completely closed position, the regulating system permits greatly reducing the air flow through the compressor and consequently the power required to drive it. Such an adaptation is required in the starting up stages of certain rotating machines having an external or auxiliary compressor.

In conventional adaptation devices of the type described hereinbefore, and for a given range of the angular setting of the vanes, the latter impose on the gas stream a gyratory flow in the direction toward the inlet of the compressor. This operation is desired to satisfy a certain incidence on the mobile blades of the compressor.

Under certain operating conditions, and in the case of the completely closed position for the vanes, an excessive heating may occur inside the compressor which results from an insufficient gas flow which heat then travels through the turboshaft machine. This heating may be harmful to the mechanical resistance and performance of the unit.

In order to overcome this drawback, it has already been proposed to construct means controlling the regulating system in which an actuating jack actuating the vanes provides a very small clearance between the vanes, in the closed position, so as to maintain a minimum gas flow through the compressor and avoid that the latter does not overheat. However, the resulting control means and the actuating jack are then of a complex and costly structure.

Further, upon the stopping of the turboshaft machine, the directing vanes are in the position of complete closure or substantially complete closure, and it is necessary to disassemble a part of the air intake device to effect an endoscopic inspection of certain elements of the auxiliary power unit, for example of the blades and vanes of the compressor. This inspection also necessitates being in a position, when the turboshaft machine stops, to control the regulating system so as to bring the vanes to their position termed the completely open position.

SUMMARY OF THE INVENTION

An object of the invention is to provide a regulating system of the type mentioned hereinbefore which permits simultaneously remedying the operational drawbacks just mentioned for a turboshaft machine.

The invention therefore provides a regulating system comprising a series of directing vanes mounted to be movable between an open position and a closed position of an air intake conduit of the turboshaft machine, characterized in that at least one of the vanes contains an opening which extends through the profiled body of the directing vane.

According to other features and advantages of the invention:

the opening in the vane places in communication the intrados and the extrados of the vane;

the opening is arranged in the central part of the vane;

the opening is in the form of a slot which extends substantially along the direction of gas flow along the vane;

the vanes are arranged in a ring and each vane is mounted to be pivotal about an axis parallel to the axis of the ring; and in the closed position, the trailing edge and the leading edge of two consecutive vanes are substantially adjacent, with the two vanes touching each other.

The invention also provides a centrifugal compressor comprising an air intake system arranged in accordance with the teaching of the invention.

The invention further provides an auxiliary power unit employing a gas turbine, the auxiliary power unit including an external centrifugal charge compressor for which the air intake system is equipped with a regulating system according to the teaching of the invention.

Further features and advantages of the invention will be apparent from the following detailed description with reference to the accompanying drawings in which:

BRIEF DESCRIPTION OF THE DRAWINGS

FIG. 5 is a view similar to FIG. 4 but in which the directing vanes are represented in the completely closed position;

FIG. 6 is a view similar to FIGS. 4 and 5 but in which the directing vanes are represented in the intermediate position corresponding to a gyratory flow on the downstream side of the vanes, and FIG. 7 is a perspective view of a directing vane defining an opening for putting the extrados in communication with the intrados of the vane, and corresponding to an embodiment of the invention.

DETAILED DESCRIPTION OF AN EMBODIMENT

The regulating system according to the invention is applicable in particular in the case of auxiliary power units employing a gas turbine, as will be described in more detail hereinafter, but of course it may also be used in other turboshaft machines or industrial apparatuses having for example a rotary compressor of one or more stages provided with directing vanes of variable settings, such as turbomotors, turbopropellers, turbocompressors, auxiliary power units employing a takeoff, etc. Of course, this compressor may be of the axial, radial or mixed flow type. Likewise, the compressor air inlet may be radial, axial or mixed flow type.

Figure 1:
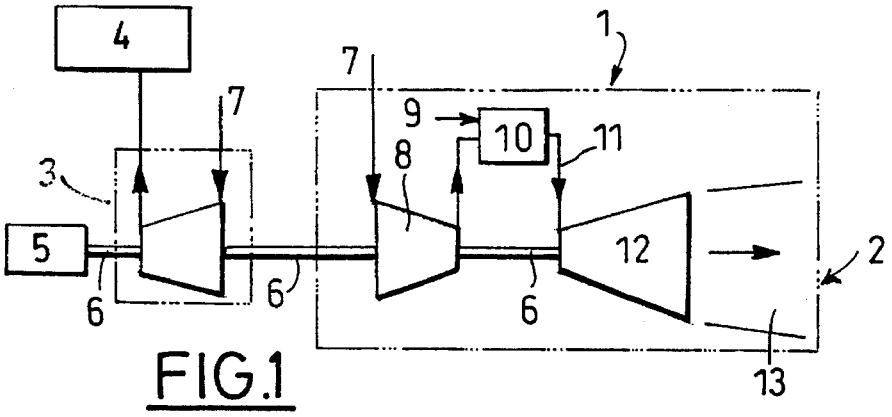
FIG. 1 is a diagram of an auxiliary power unit employing a gas turbine and an external charge compressor which may be equipped with a regulating system according to the invention.
Figure 3:
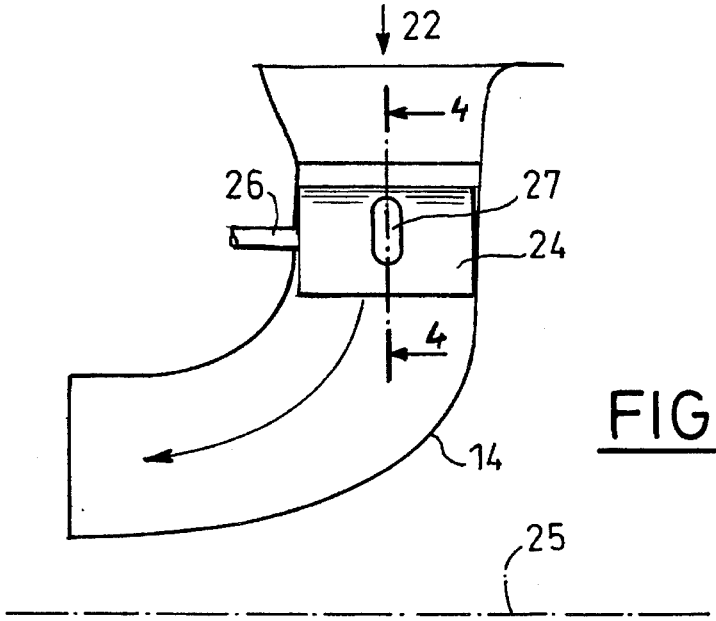
FIG. 3 is a half-sectional view of an air intake conduit of the charge compressor illustrated in FIG. 2.

In FIG. 1 there is shown by way of example a diagram of an auxiliary power unit employing a gas turbine and including a charge compressor equipped with a regulating system according to the invention.

In the embodiment shown in FIG. 1, this power unit, designated by the general reference character 1, comprises a turbomotor 2 diagrammatically represented in the zone defined by a dot-dash line contour. This turbomotor 2 is employed for driving a charge compressor 3 delivering compressed air to an accessory pneumatic unit 4, such as for example an air conditioning system of an aircraft, or to other devices actuated by compressed air such as motors having a pneumatic turbine or the like. The turbomotor 2 is also adapted to drive an electricity generator 5.

These various units 2, 3 and 5 are coupled together by a drive shaft 6 which may include for example a conventional speed reducer (not shown).

When the turbomotor 2 operates, surrounding air is drawn in at an inlet 7 of a compressor 8 of the turbomotor. The compressed air at the compressor outlet is mixed with a fuel 9 before being injected into a combustion chamber 10 where it is continuously burned.

The burned gases at 11 are expanded in an axial turbine 12 having two stages so as to furnish the desired power to the drive shaft 6 before being ejected to the atmosphere through an exhaust pipe 13 located on the downstream side of the turbine 12.

The rotation of the drive shaft 6 drives the power unit compressor 8, the charge compressor 3, the electric generator 5 and possibly other accessories.

Figure 2:
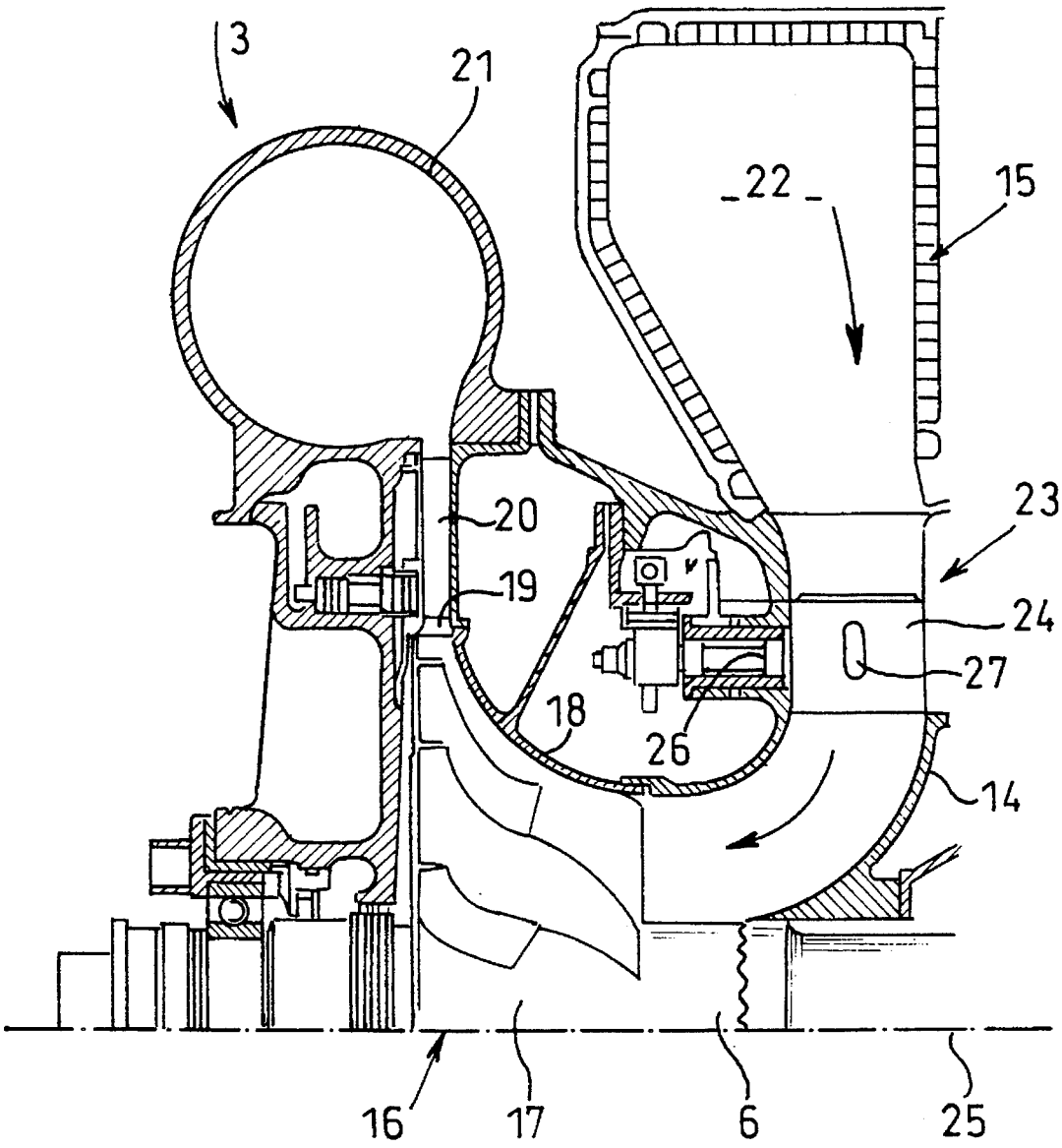
FIG. 2 is a half-sectional view of a charge compressor of an auxiliary power unit equivalent to that shown in FIG. 1 and equipped with a regulating system according to the invention.
Figure 8:
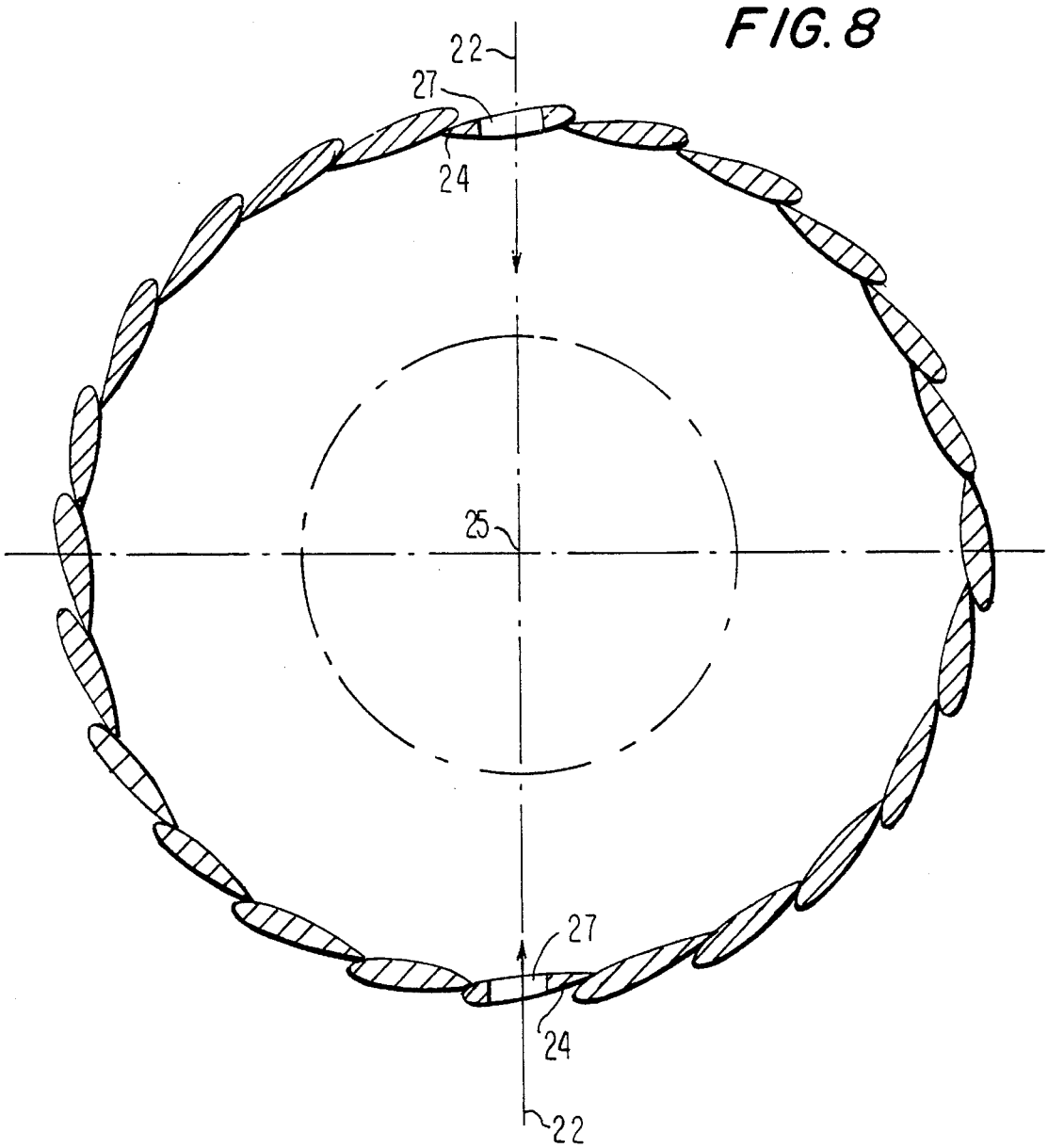
FIG. 8 is a sectional view showing the directing vanes all in a closed position with an opening provided through two diametrically opposed vanes.
Figure 9:
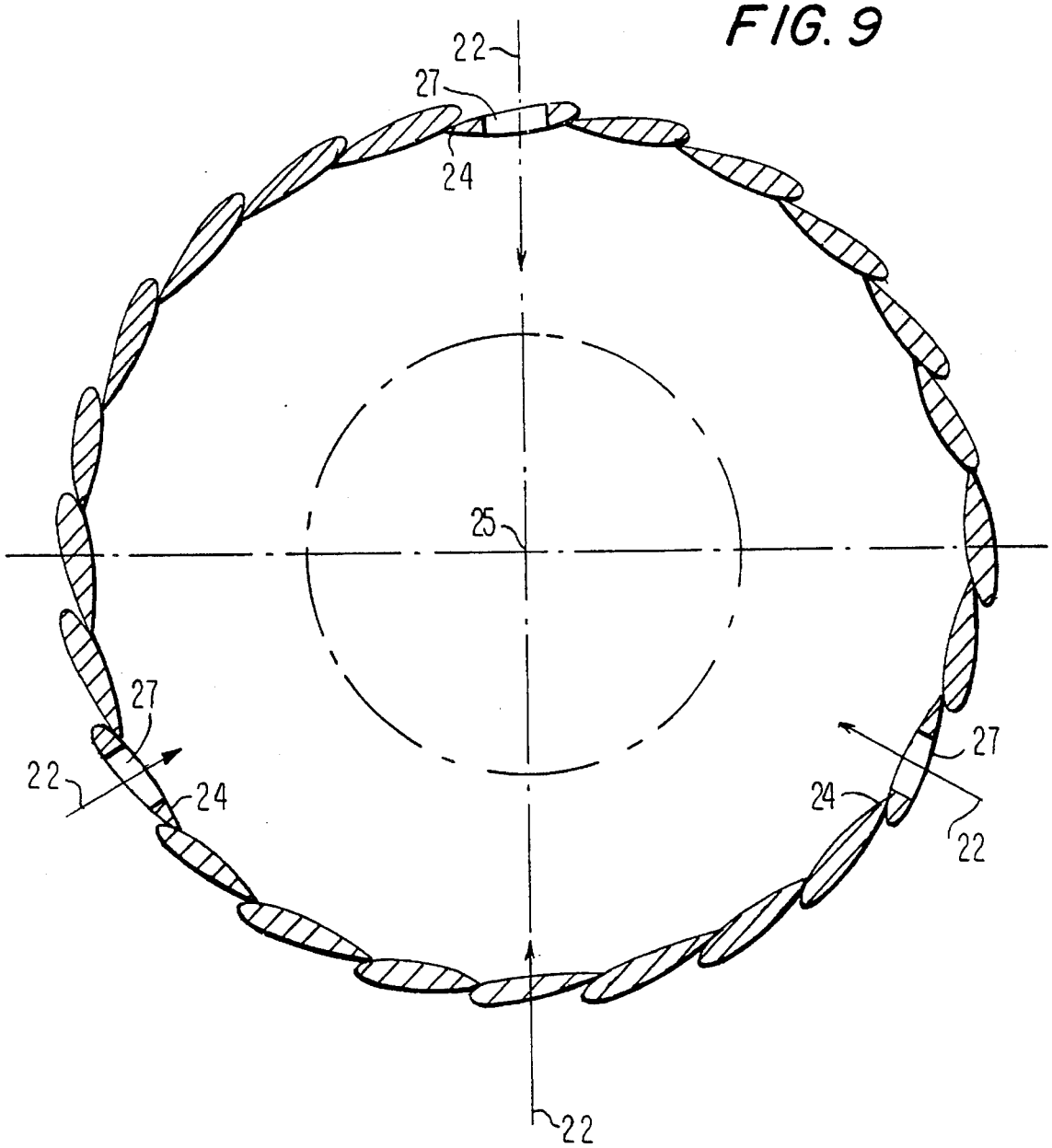
FIG. 9 is a sectional view similar to FIG. 8 except with an opening provided in three directing vanes each disposed at 120° angle to one another.

As can be seen in FIG. 2, the compressor 3 comprises an annular air intake conduit 14 permitting the aspiration of air from a plenum 15 and the supply of air to a centrifugal impeller 16. The centrifugal impeller 16 comprises a series of blades 17 for transforming into pneumatic energy the mechanical energy transmitted through the drive shaft 6. Air leakages along the top of the blades 17 are limited by a static cover 18.

The charge compressor 3 also comprises a diffuser unit constituted by a first diffuser 19, a radial diffuser 20 having vanes and a scroll or volute 21 which is adapted to supply compressed air to the pneumatic unit 4 mentioned hereinbefore.

When the charge compressor 3 operates, the surrounding air, designated by the general reference character 22 in FIG. 2 is aspirated in the air supply plenum 15 on the whole of the periphery of the air inlet.

The radial inward flow of the air is then converted into an axial flow for suitably supplying air to the impeller 16. The air 22 is compressed by the rotating blades 17 and is driven tangentially in the diffuser unit. The kinetic energy of the air leaving the impeller 16 is then converted into pressure in the smooth first diffuser 19 and in the vaned radial diffuser 20. At the outlet of the diffuser unit, the air is collected in the scroll 21 and sent to the pneumatic unit 4.

Means for regulating the air supply conditions of the compressor 3 are also provided for regulating the air flow and the pressure level delivered to the pneumatic unit 4. These means are constituted by a regulating system designated by the general reference character 23 in FIG. 2, which comprises a series of directing vanes 24 disposed in the radial part of the annular air inlet conduit 14.

As can be seen in FIGS. 2 to 6, the vanes 24 are disposed in a ring shape on the radial part of the gas inlet conduit at even intervals on a control diameter centered on the axis 25 of the rotary machine. The vanes 24 have a variable setting and are orientable simultaneously by control shafts 26 and an auxiliary mechanical control unit 28.

By modifying as required the setting of the vanes 24, it is possible to regulate with precision the air supply conditions of the compressor 3 and therefore adapt the flow and the pressure level delivered to the different components supplied with air by this compressor.

In particular, and in the completely closed vane position illustrated in FIG. 5, the regulating system permits greatly reducing the air flow through the compressor and consequently the power required to drive it from the turbomotor 2 through the shaft 6.

In the case of the completely closed vane position illustrated in FIG. 5, there may occur an excessive heating on the downstream sidle of the directing vanes 24 which is harmful to the mechanical resistance of the whole of the compressor, and in particular the resistance of the impeller 16, the radial diffuser 20 and/or the scroll 21.

Figure 4:
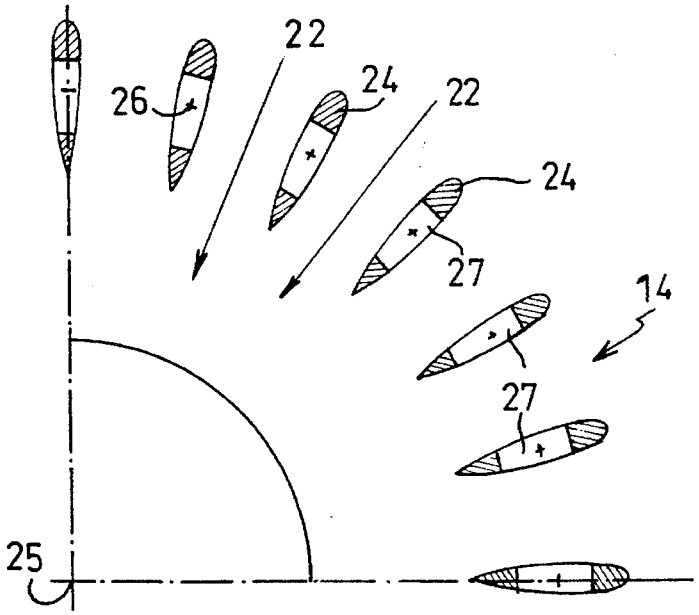
FIG. 4 is a half-sectional view of the annular conduit of the charge compressor taken on line 4—4 of FIG. 3, in which the directing vanes are represented in the completely open position.

Lastly, when the turboshaft machine 1 stops, the directing vanes 24 are in the completely closed position and it is then necessary to disassemble the control system 28 to return the directing vanes to the completely open position, illustrated in FIG. 4, to permit an endoscopic inspection of the blades 17 and diffuser vanes 20 of the charge compressor 3.

According to the invention, at least one directing vane 24 includes an opening or passageway 27 for putting the extrados side of the vane in flow communication with the intrados of the vane.

As illustrated in FIG. 7, the opening 27 may be in the form of a longitudinal throughway slot, i.e. which extends in the median part of the directing vane 24 substantially in the longitudinal direction of the gas flow along the vane.

Such communicating openings 27 may be provided in all of the directing vanes 24, in a single vane, in two diametrically opposed vanes, in three vanes disposed at 120° to one another, or in any other arrangement of the vanes 24.

It will be understood that the choice of this configuration, the shape, the size and the position of the openings in the vanes 24 permit optimizing the different parameters of operation of the regulating system according to the invention.

Further, for angular setting positions close to the completely open position of the regulating system, the openings 27 are inoperative owing to the small pressure difference between the intradoses and the extradoses of the directing vanes.

The regulating system according to the invention is particularly simple to construct in that it requires no additional mechanical element and it moreover permits a slight reduction in the weight of the system.

The endoscopic inspection of the impeller blades 17 is carried out very simply in the completely closed position of the vanes 24 by introducing an endoscope through an opening 27 in a vane.

Lastly, for certain conditions of operation of the turboshaft machine corresponding to predetermined flow ranges and flow angle of the gas stream, the gyratory movement imparted to the gas stream on the downstream side of the directing vanes 24 may produce an undesirable aerodynamic noise owing to the sound disturbance created in the immediate environment, owing to the corresponding loss of energy inside the annular conduit and owing to risks of vibratory excitation of the mechanical parts disposed in proximity to this conduit.

The presence of the openings in the vanes attenuates or eliminates this undesirable noise in accordance with the teaching of document DE-A-2,227,460.

What is claimed is:

1. A centrifugal compressor assembly comprising an air intake conduit and a system for regulating air supply conditions of said centrifugal compressor, said system comprising in combination a series of directing vanes mounted in said compressor air intake conduit so as to be moveable between an open position and a closed position, said directing vanes all being mounted in a ring shape with each said vane being pivotable about an axis parallel to the axis of said ring, and including a throughway opening extending longitudinally through at least one said vane for creating a secondary air flow through said regulating system.

2. A centrifugal compressor assembly according to claim 1, wherein said throughway opening extending through the profiled body of said at least one vane is provided in a central part of the vane.

3. A centrifugal compressor assembly according to claim 2, wherein said longitudinal throughway opening is provided in all of said directing vanes.

4. A regulating system for regulating air supply conditions for a rotary compressor having an air intake conduit, said regulating system comprising in combination a series of directing vanes (24) mourned in said compressor air intake conduit (14) and arranged in a ring shape, with each said directing vane (24) being mounted to be pivotable about an axis parallel to the axis of said ring, said vanes (24) all being moveable between an open position and a closed position and include means wherein at least one of said moveable directing vanes (24) includes a longitudinal throughway opening (27) extending through the profiled body of said at least one vane for creating a secondary air flow through the regulating system, whereby said longitudinal throughway opening avoids excessive heating of the compressor blades whenever the vanes (24) are in a substantially closed position, the longitudinal passageway (27) allowing the endoscopic inspection of the compressor blades through the longitudinal throughway open (27) in said at least one moveable directing vane (24) when the vanes are in a closed position.

5. A regulating system for a rotary compressor according to claim 4, wherein said throughway opening (27) puts the intrados in flow communication with the extrados of said at least one vane (24).

6. A regulating system for a rotary compressor according to claim 5, wherein said throughway opening (27) is provided in a central part of said at least one vane (24).

7. A regulating system for a rotary compressor according to claim 4, wherein one said longitudinal throughway opening (27) is provided in each of three directing vanes (24) disposed at an angle of 120° to each other.

8. A regulating system for a rotary compressor according to claim 6, wherein said throughway opening (27) is in the form a central elongated slot which extends substantially along the direction of gas flow relative to said at least one vane (24).

9. A regulating system for a rotary compressor according to claim 4, wherein in said vane (24) closed position two consecutive vanes (24) have a trailing edge and a leading edge which are adjacent, said adjacent vane edges being in touching relation.

10. A regulating system for a rotary compressor according to claim 4, wherein said longitudinal throughway opening (27) is provided in all of said directing vanes (24).

11. A regulating system for a rotary compressor according to claim 4, wherein one said longitudinal throughway opening (27) is provided in each of two diametrically opposed directing vanes (24).

* * * * *